United States Patent [19]

Maier

[11] Patent Number: 4,557,213

[45] Date of Patent: Dec. 10, 1985

[54] APPARATUS FOR FURLING SAILBOAT JIB

[75] Inventor: Charles Maier, Port Clinton, Ohio

[73] Assignees: James R. Longacre; Richard Hendricks, both of Washington, D.C.

[21] Appl. No.: 660,990

[22] Filed: Oct. 15, 1984

[51] Int. Cl.[4] ..... B63H 9/10

[52] U.S. Cl. ..... 114/106; 114/107

[58] Field of Search ..... 114/106, 107, 105, 104; 464/52

[56] References Cited

U.S. PATENT DOCUMENTS

| | | | |
|---|---|---|---|
| 3,481,156 | 12/1969 | Csipkes | 464/52 |
| 3,980,036 | 9/1976 | Crall | 114/106 |
| 4,267,790 | 5/1981 | Hood | 114/106 |

FOREIGN PATENT DOCUMENTS

| | | | |
|---|---|---|---|
| 70005 | 1/1945 | Norway | 114/106 |

OTHER PUBLICATIONS

The Wm. H. Whiting Co., Catalog 35, 1982, p. 183, Winch DL1700.

*Primary Examiner*—Trygve M. Blix
*Assistant Examiner*—Thomas J. Brahan
*Attorney, Agent, or Firm*—Cushman, Darby & Cushman

[57] ABSTRACT

Apparatus for furling a sailboat jib about a forestay with a cylindrical sleeve mounted about the forestay to which the jib is attached, a deck mounted rotary actuator for rotating the sleeve to furl the jib, a manually operated gear box, and a flexible shaft coupling the gear box to the actuator. The apparatus can be adapted to existing roller furlers by a split ring adapter.

9 Claims, 4 Drawing Figures

APPARATUS FOR FURLING SAILBOAT JIB

BACKGROUND AND SUMMARY OF THE INVENTION

The invention relates to an apparatus for furling a sailboat jib about a forestay.

Most sailboats, particularly larger boats intended primarily for cruising, are designed to carry a jib. Conventionally the jib is attached to a forestay extending between the bow of the boat and the mast. On such boats roller furlers are conventionally used to wrap the jib around the forestay for storage.

Conventional roller furlers include a cylindrical sleeve mounted for rotation about the forestay and attached to the jib at either end. At the lower end of the sleeve a drum is mounted to which a rope is attached permitting rotation of the drum and hence furling and unfurling of the jib from the cockpit. While such rollers are indeed useful, evidenced by the fact that many sailboats of this type are equipped with the same, they have a considerable number of drawbacks.

First, even with the use of a deck winch it is almost impossible to furl the jib in a strong wind. Second, the rope attached to the drum tends to chafe and break, usually at a difficult time. In a reefing condition the rope stretches during use and it is difficult it not possible to retighten the jib under full sail to compensate for the stretch. The rope necessarily obstructs the deck and can catch on the drum, deck fittings and turnbuckles. Moreover, it is easy to forget to cleat the rope, and this results in the jib coming loose at unfortunate times.

The present invention relates to an improved apparatus of this type which overcomes the above noted problems with rotary furlers now in use. The apparatus uses a cylindrical sleeve which is mounted about the forestay in the same fashion as corresponding sleeves on existing roller furlers as described above. Indeed the present invention can be readily adapted to modify such existing roller furlers and avoid the need for a complete retrofit.

A rotary actuator is mounted on the deck adjacent the forestay and coupled to the sleeve for rotating the same to furl the jib. Preferably, the rotary actuator includes a pair of right angle driving and driven gears mounted within a suitable bracket. A gear box is mounted to the sailboat at a location remote from that of the rotary actuator, preferably near the cockpit where it can be most conveniently and easily operated by the captain or crew. The gear box is coupled to the rotary actuator, preferably by a flexible cable which can be guided as desired and thus placed where it will not easily be fouled or tripped over by crew members. For example the flexible shaft may be guided by suitable guide members along the toe rail or even under the deck. The use of a gear box provides any desired mechanical advantage and makes possible for the first time furling of the jib under full sail and even reefing of the jib to meet changing wind conditions.

When the apparatus is to be adapted to conventional roller furlers a split adapter can be employed having a diameter to match the diameter of any given existing roller furler. Existing roller furlers from different manufacturers have sleeves of different diameters but by providing a limited set of split adapters the present invention can be adapted to almost any existing roller furler.

Other objects and purposes of the invention will be clear from the following detailed description of the drawings.

DETAILED DESCRIPTION OF THE DRAWINGS

Figure 1:
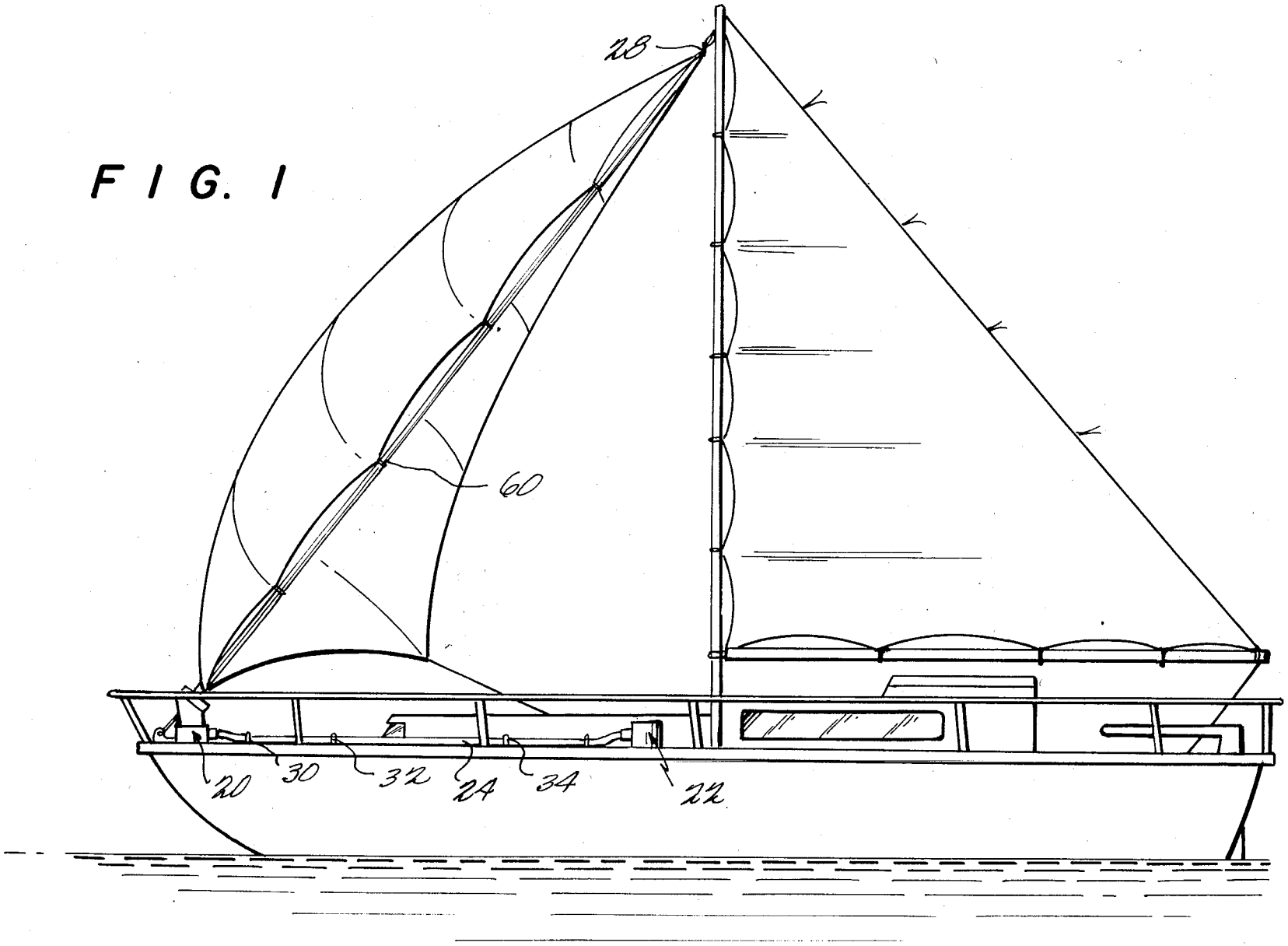
FIG. 1 shows a schematic side view of a sailboat with the apparatus of the present invention mounted for furling a jib.
Figure 2:
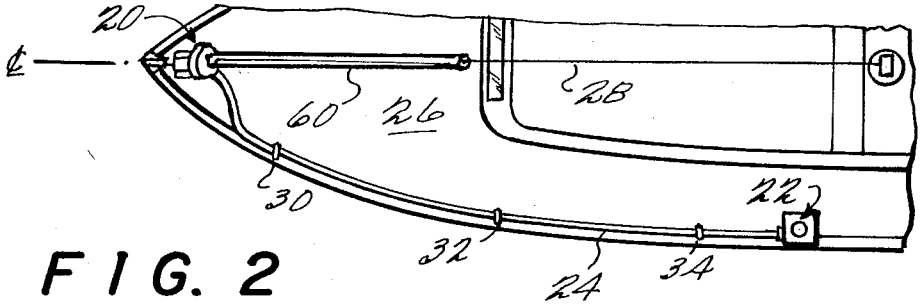
FIG. 2 shows a top schematic view of a sailboat with the apparatus of the present invention.
Figure 3:
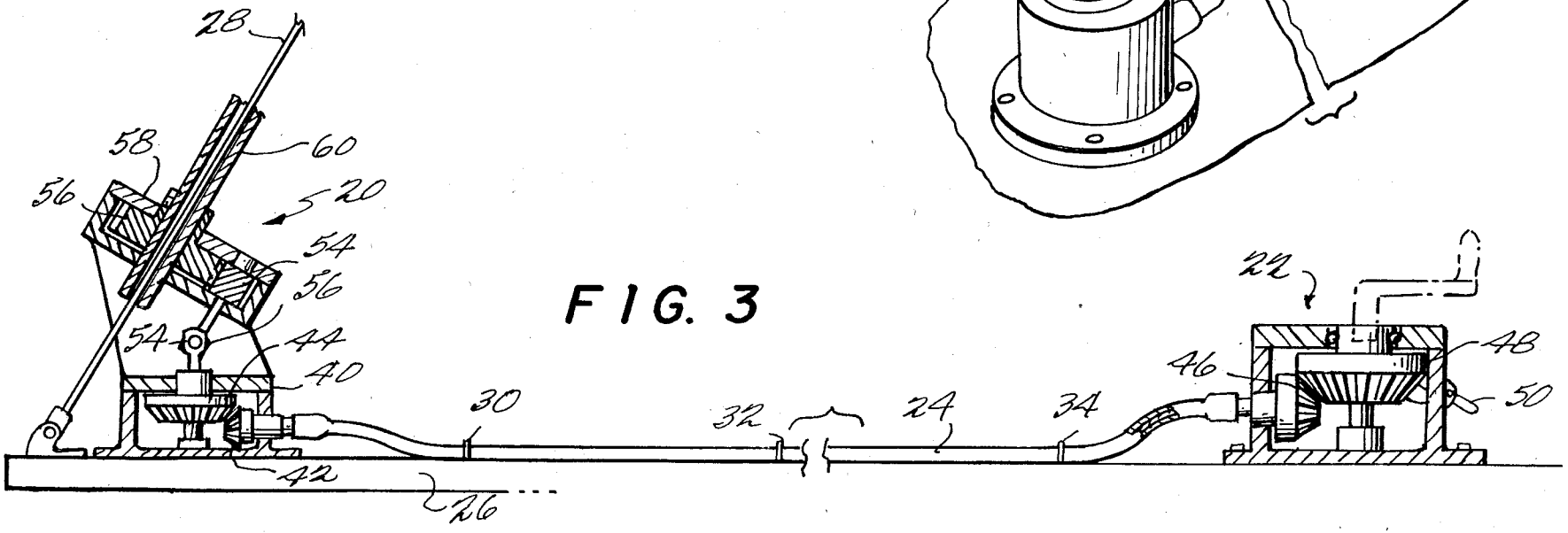
FIG. 3 shows a side and partial sectional view of one embodiment of the present invention.

Reference is now made to FIGS. 1–3 which illustrate a first embodiment of the present invention. The apparatus of the present invention as can be seen schematically in FIGS. 1 and 2 includes a rotary actuator 20, a gear box 22, and a mechanism 24, preferably a flexible shaft, for coupling gear box 22 to the rotary actuator 20. Actuator 20 is mounted on the deck 26 near the attachment of that forestay 28 to the bow. The gear box 22 is mounted on the same deck but considerably to the rear of actuator 20 so as to be conveniently operable by the captain or crew from the cockpit. The exact location of gear box 22 may vary from sailboat to sailboat depending on the specific sailboat design and the desire of its owner.

Flexible shaft 24 which couples gear box 22 to actuator 20 can be mounted however is most convenient and out of the way of crew members. One convenient way is to use a plurality of guides, for example, guides 30, 32, and 34 mounted to extend non-linearly along the toe rail of the sailboat to guide the flexible shaft 24 as illustrated. Alternatively, shaft 24 may extend beneath the deck between gear box 22 and actuator 20.

As can be best seen in FIGS. 2 and 3 actuator 20 includes a housing 40 for a driven gear 42 and a driving gear 44, the respective gears being vertically mounted by the housing with respect to each other. Driving gear 42 is coupled by flexible shaft 24 to a driving gear 46 in gear box 22. Gear 46 is in turn driven by gear 48 by a conventional handle which may be manually removable in the same fashion as in winches now in use on every sailboat. A conventional rachet 50 engages gear 48 in a first position to permit gear 48 to rotate only in a direction which will furl the sail. To release the sail rachet 50 need only be manually rotated to its second position out of engagement with gear 48 at which time all of the gears will be able to turn freely and the sail will be automatically unfurled by the wind pressure. As noted above, gear box 22 may be mounted on the deck or may be flush with the deck.

A conventional universal joint 54 couples gear 44 to a second set of gears 54 and 56 in a second housing 58 attaching directly to sleeve 60 to which the jib is attached. Sleeve 60 is mounted as shown for rotation about forestay 28 which is in turn coupled to deck 26 adjacent to where rotary actuator 20 is attached.

Figure 4:
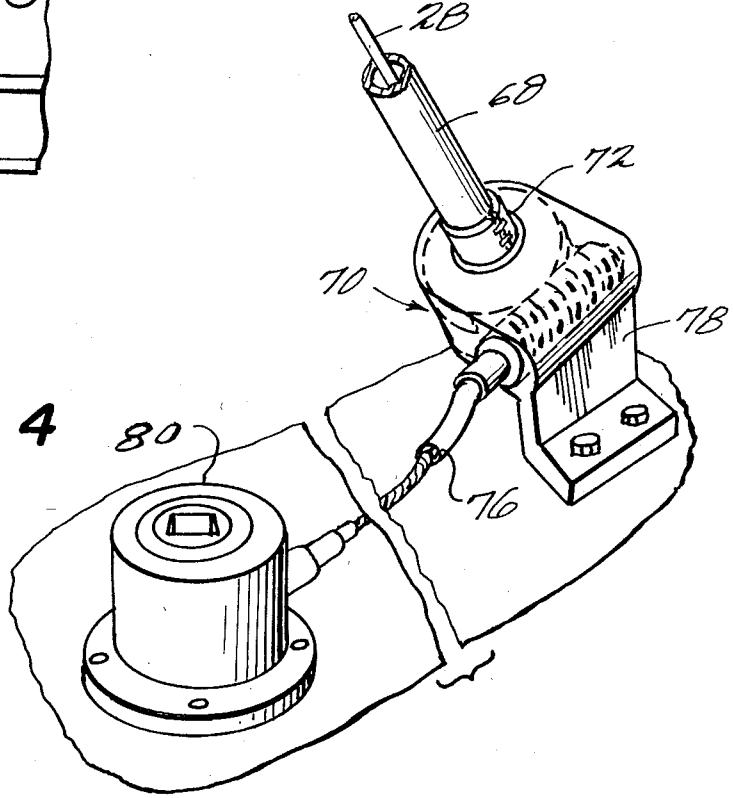
FIG. 4 shows a perspective view of an apparatus according to the present invention adapted for use with an existing roller furler.

The present invention is not only suitable for mounting on new sailboats or for retrofitting existing sailboats but can also be readily adapted to conventional roller furlers now in use. One arrangement for adapting to existing roller furlers is shown in FIG. 4. The existing sleeve 64 and drum core 68 of the roller furler are retained. Rotary actuator 70, includes worm and driven gears and is coupled to the drum core by a split ring adapter 72 with a suitable keyway. Adapter 72 is chosen to have a diameter matching the diameter of drum core 68. Although different roller furlers from different manufacturers have different diameters of drum core a limited number of the split adapters will permit the present invention to be adapted to virtually any existing roller furler. Sleeve 76 connects to gears within the rotary adapter 70 in the same way as described above and housing 78 of the roller furler is similarly attached to the deck. A gear box 80 is manually operated as described above and coupled to rotary actuator 70 by flexible shaft 78.

Many changes and modifications in the above described embodiments of the invention can be carried out without departing from the scope of the invention. Accordingly, that scope is intended to be limited only be the scope of the appended claims.

What is claimed is:

1. An apparatus for furling a sailboat jib about a forestay attached at one end to the deck and at the other end to a mast from a main cockpit comprising:

a sleeve adapted for being mounted for rotation about said forestay and for attachment on the exterior surface thereof to said jib;

rotary actuator means coupled to said sleeve for rotating said sleeve to furl said jib and adapted for attachment to the sailboat deck adjacent the attachment of said forestay;

a gear box adapted for attachment to said sailboat near said main cockpit and at a location remote from the location of said rotary actuator and having gears therein for manual rotation; and means including a flexible shaft extending non-linearly along the deck from said rotary actuator means to said gear box for coupling said gear box to said rotary actuator means so that rotation of said gears within said gear box rotates said actuator means and sleeve to furl said jib by manual operation from said main cockpit.

2. An apparatus as in claim 1 wherein said rotary actuator means included a first housing adapted for attachment to said deck and including at least two right angle gears, a second housing adapted for attachment to said sleeve and including first and second gears and a universal joint connector between a driven gear in said first housing and a driving gear in said second housing.

3. An apparatus as in claim 1 wherein said coupling means includes a plurality of guides through which said flexible shaft passes and adapted for attachment to said sailboat.

4. An apparatus as in claim 1 wherein said gear box includes at least first and second gears and a rachet for engaging one of said gears and adapted for manual movement between a first position preventing rotation of said one gear in a direction permitting said sleeve to rotate and unfurl said jib and a second position permitting rotation of said one gear to unfurl said jib.

5. An apparatus for connection to a forestay sleeve for mounting a sailboat jib for rotation about a forestay to furl and unfurl said jib from said main cockpit comprising:

rotary actuator means coupled to said sleeve for rotating said sleeve to furl said jib and adapted for attachment to the sailboat deck adjacent the attachment of said forestay;

adapter means for coupling said rotary actuator means to said sleeve;

a gear box adapted for attachment to said sailboat near said main cockpit and at a location remote from the location of said rotary actuator and having gears thereon for manual rotation and means including a flexible shaft extending non-linearly along the deck from said rotary actuator means to said gear box for coupling said gear box to said rotary actuator means so that the rotation of said gears within gear box rotates said actuator means and sleeve to furl said jib by manual operation from said main cockpit.

6. An apparatus as in claim 5 wherein said adapter means is a split ring adapter having an interior diameter equal to the exterior diameter of said sleeve.

7. An apparatus as in claim 5 wherein said actuator means includes a worm gear driven by said coupling means, a gear driven by said worm gear for rotating said sleeve and a housing for said gears.

8. An apparatus as in claim 5 wherein said coupling means includes a plurality of guides through which said flexible shaft passes and adapted for attachment to said sailboat.

9. An apparatus as in claim 5 wherein said gear box includes at least first and second gears and a rachet for engaging one of said gears and adapted for manual movement between a first position preventing rotation of said one gear in a direction permitting said sleeve to rotate and unfurl said jib and a second position permitting rotation of said one gear to unfurl said jib.

* * * * *